US010331073B2

(12) United States Patent
Diamant et al.

(10) Patent No.: US 10,331,073 B2
(45) **Date of Patent: *Jun. 25, 2019**

(54) CLEANING A SILICON PHOTOCONDUCTOR

(71) Applicant: HP Indigo, B.V., Amstelveen (NL)

(72) Inventors: Reut Diamant, Ness Ziona (IL); Sasi Moalem, Ness Ziona (IL); Boaz Tagansky, Rishon Letzion (IL)

(73) Assignee: HP Indigo B.V., Amstelveen (NL)

( * ) Notice: Subject to any disclaimer, the term of this patent is extended or adjusted under 35 U.S.C. 154(b) by 0 days.

This patent is subject to a terminal disclaimer.

(21) Appl. No.: 16/032,949

(22) Filed: Jul. 11, 2018

(65) Prior Publication Data

US 2018/0321630 A1 Nov. 8, 2018

Related U.S. Application Data

(63) Continuation of application No. 15/511,711, filed as application No. PCT/EP2014/069898 on Sep. 18, 2014, now Pat. No. 10,025,256.

(51) Int. Cl.
*G03G 21/00* (2006.01)
*G03G 5/00* (2006.01)

(52) U.S. Cl.
CPC ..... *G03G 21/0058* (2013.01); *G03G 5/005* (2013.01); *G03G 21/0005* (2013.01); *G03G 21/007* (2013.01); *G03G 21/0088* (2013.01); *G03G 21/0094* (2013.01)

(58) Field of Classification Search
CPC ..... G03G 21/0058; G03G 21/0005; G03G 21/007; G03G 21/0088; G03G 21/0094; G03G 5/005
See application file for complete search history.

(56) References Cited

U.S. PATENT DOCUMENTS

| | | | |
|---|---|---|---|
| 3,862,801 | A | 1/1975 | Komp |
| 3,867,170 | A | 2/1975 | Ferguson et al. |
| 3,979,317 | A | 9/1976 | Angelini |
| 6,156,471 | A | 12/2000 | Kobori et al. |
| 6,258,499 | B1 | 7/2001 | Itami |
| 6,992,017 | B2 | 1/2006 | Peng et al. |
| 7,270,597 | B2 | 9/2007 | Svirchevski et al. |

(Continued)

FOREIGN PATENT DOCUMENTS

| | | |
|---|---|---|
| GB | 1353207 | 5/1974 |
| JP | 2006243202 | 9/2006 |
| WO | WO-2016018307 | 2/2016 |

OTHER PUBLICATIONS

Bachman, Mark, "RCA-1 silicon wafer cleaning" INRF application note Engineering of Microworld at the University of California, Irvine, Feb. 20, 2009, 3 pages. http://www.inrf.uci.edu/wordpress/wp-content/uploads/sop-wet-silicon-rca-1.pdf.

(Continued)

*Primary Examiner* — David M. Gray
*Assistant Examiner* — Michael A Harrison
(74) *Attorney, Agent, or Firm* — Mannava & Kang

(57) ABSTRACT

In an example implementation, a method of cleaning a silicon photoconductor includes contacting the silicon photoconductor with a base-peroxide solution, rinsing the silicon photoconductor with a liquid, and heating the silicon photoconductor to evaporate the liquid.

18 Claims, 3 Drawing Sheets

(56) References Cited

U.S. PATENT DOCUMENTS

| | | | | |
|---|---|---|---|---|
| 7,799,140 | B1 | 9/2010 | Altavela | |
| 10,025,256 | B2 * | 7/2018 | Diamant | G03G 21/0058 |
| 2008/0069618 | A1 | 3/2008 | Ishino | |
| 2008/0213686 | A1 | 9/2008 | Nagai | |
| 2013/0252427 | A1 | 9/2013 | Song | |

OTHER PUBLICATIONS

International Search Report and Written Opinion dated Jul. 20, 2015, PCT Patent Application No. PCT/EP2014/069898, filed Sep. 18, 2014, European Patent Office, 13 pages.

* cited by examiner

CLEANING A SILICON PHOTOCONDUCTOR

PRIORITY

This application is a Continuation of commonly assigned and co-pending U.S. patent application Ser. No. 15/511,711, filed Mar. 16, 2017, which is a national stage filing under 35 U.S.C. § 371 of PCT Application Number PCT/EP2014/069898, having an international filing date of Sep. 18, 2014, the disclosures of which are hereby incorporated by reference in their entireties.

BACKGROUND

Electro-photographic (EP) printing devices form images on print media by placing a uniform electrostatic charge on a photoconductor and then selectively discharging the photoconductor in correspondence with the images. The selective discharging forms a latent electrostatic image on the photoconductor. Colorant is then developed onto the latent image of the photoconductor, and the colorant is ultimately transferred to the media to form the image on the media. In dry EP (DEP) printing devices, toner is used as the colorant, and it is received by the media as the media passes below the photoconductor. The toner is then fixed in place as it passes through heated pressure rollers. In liquid EP (LEP) printing devices, ink is used as the colorant instead of toner. In LEP devices, an ink image developed on the photoconductor is offset to an image transfer element, where it is heated until the solvent evaporates and the resinous colorants melt. This image layer is then transferred to the surface of the print media being supported on a rotating impression drum.

Achieving high print quality (PQ) with an electrophotographic printing device depends in part on keeping the photoconductor clean, so that it has a high surface resistivity that can maintain the electrostatic latent image. However, during the normal printing process, the photoconductive surface accumulates contamination and becomes oxidized. The photoconductive surface can also absorb moisture. The contaminants, oxidation, and moisture, can create lateral conductivity across the surface, resulting in poor PQ, blurriness of edges, and elimination of small elements such as dots and lines.

BRIEF DESCRIPTION OF THE DRAWINGS

The present embodiments will now be described, by way of example, with reference to the accompanying drawings, in which.

Throughout the drawings, identical reference numbers designate similar, but not necessarily identical, elements.

DETAILED DESCRIPTION

Figure 1:
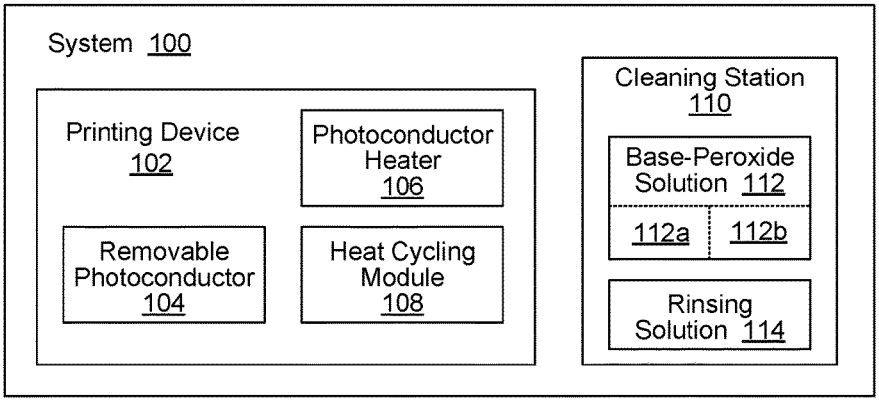
FIG. 1 shows an example of a system for cleaning an amorphous silicon photoconductor.

Photoconductors in electrophotographic printing devices generally comprise a photo imaging component such as an amorphous silicon photoreceptor mounted on or wrapped around an imaging drum or cylinder. The photoreceptor defines an outer surface of the imaging drum on which images can be formed. Over time, as an electrophotographic printing device produces more and more printed output, the surface of the amorphous silicon photoconductor becomes contaminated and develops an outer oxidized layer. The photoconductive surface can also absorb moisture, and contaminants including dirt and other matter can accumulate on the photoconductive surface, for example, by attaching to water vapor. This layer of contamination and oxidation reduces the photoconductor's ability to print clearly, especially with regard to smaller printed elements such as lines and dots. The contaminated surface of the amorphous silicon photoconductor causes lateral conductivity across the surface that interferes with the formation and strength of latent images on the photoconductor. The lateral conductivity enables ink to move around on the photoconductor surface instead of staying in place. This can cause print quality issues such as printed lines that collide with one another so they appear as branches of a tree instead of as straight lines.

Removing contamination from the surface of an amorphous silicon photoconductor has been shown to substantially improve or restore the print quality of electrophotographic printing devices. Prior methods of cleaning the surface of such photoconductors include the use of abrasion techniques that grind off the contamination layer. Unfortunately, such techniques also typically involve contacting the silicon surface of the photoconductor with abrasive material during cleaning, which can grind down and/or deplete the surface of the photoconductor, leading to a significant reduction in photoconductive depth. Such depth reductions can shorten the lifespan of the photoconductor and thereby increase the overall cost of operating the electrophotographic printing device.

Accordingly, example methods and systems described herein provide for the cleaning of a silicon photoconductor in a manner that restores high print quality without depleting the photoconductor or otherwise reducing its lifespan. A cleaning process includes contacting the photoconductor with a base-peroxide solution, and then rinsing it with a rinsing solution. In some examples, application of the base-peroxide solution and rinsing solution can take place inside a cleaning station after removing the photoconductor from a printing device. Following the cleaning and rinsing in the cleaning station, the photoconductor surface is wiped substantially dry and then exposed to heat treatment cycles to evaporate the remaining rinsing solution from the photoconductor. The cleaning and heat cycling of the silicon photoconductor significantly improves the quality of printed pages produced with the photoconductor by reducing or eliminating lateral conductivity and the resulting blurriness of print features caused by the contaminants, oxide layer, and moisture.

In one example, a method of cleaning a silicon photoconductor on an imaging drum includes contacting the silicon photoconductor with a base-peroxide solution, and rinsing the silicon photoconductor with a liquid. The photoconductor is then heated to evaporate the liquid from the photoconductor. In some examples, excess liquid is wiped off the silicon photoconductor prior to heating the photoconductor.

In another example, a system for cleaning a silicon photoconductor includes an electrophotographic printing device and a silicon photoconductor that is removable from the printing device. The system also includes a cleaning station comprising a base-peroxide solution and a rinsing solution. The cleaning station is to receive the photoconductor, and within the cleaning station the photoconductor is to be brought into contact with the base-oxide solution and then rinsed with the rinsing solution. The system also includes a photoconductor heating mechanism to heat the photoconductor to evaporate remaining rinsing solution from the photoconductor.

In another example, a non-transitory machine-readable storage medium stores instructions that when executed by a processor of a printing device, cause the printing device to receive from a cleaning station, a silicon photoconductor that has been cleaned and rinsed within the cleaning station using, respectively, a base-peroxide solution and rinsing solution. In response to receiving the silicon photoconductor, the printing device is to perform heat cycling in order to evaporate any remaining rinsing solution from the silicon photoconductor.

FIG. 1 conceptually illustrates an example system 100 for cleaning a silicon photoconductor in a manner that restores high print quality without depleting the photoconductor or otherwise reducing the lifespan of the photoconductor. System 100 includes a print-on-demand electrophotographic printing device 102, such as a liquid electrophotographic printing press. The printing device 102 includes a removable photoconductor 104 for forming images to be printed. In some examples, the removable photoconductor 104 comprises an amorphous silicon photoconductive layer (i.e., a photoreceptor) mounted on, or wrapped around, an imaging drum or cylinder as further discussed herein below. Thus, as discussed herein, the removable photoconductor 104 is generally considered to comprise an amorphous silicon photoconductor 104. However, there is no intent to limit photoconductor 104 in this regard, and in other examples a photoconductor may incorporate a photoconductive layer comprising another appropriate photoconductive material such as a crystalline silicon photoconductive material.

The printing device 102, discussed in greater detail below, also includes a heating mechanism such as photoconductor heater 106, and a heat cycling module 108. In different examples, a heat cycling module 108 can comprise hardware, programming instructions, or a combination of hardware and programming instructions designed to perform a particular function or combination of functions. Hardware incorporated into module 108 can include, for example, a processor and a memory, while the programming instructions comprise code stored on the memory and executable by the processor to perform the designated function. One such function can include, for example, performing cyclical heating of the removable amorphous silicon photoconductor 104 by controlling the photoconductor heater 106, the removable photoconductor 104, and other components of printing device 102.

Along with printing device 102, system 100 includes a cleaning station 110. Cleaning station 110 comprises a base-peroxide solution 112 and a rinsing solution 114. In different examples, components of the base-peroxide solution 112 (i.e., base 112*a* and oxidizing agent 112*b*) may be retained in the cleaning station 110 separately or together. Thus, the cleaning station 110 may be adapted for the separate contact of a base 112*a* and an oxidizing agent 112*b* with the photoconductor 104. In some examples, the cleaning station 110 may comprise separate receptacles, each containing one of the base 112*a* and the oxidizing agent 112*b*, so that the photoconductor 104 can be contacted separately with the base 112*a* and the oxidizing agent 112*b*. The cleaning station 110 may be adapted to rinse the photoconductor 104 after contact with the base 112*a* and before the oxidizing agent 112*b* or, in another example, after contact with the oxidizing agent 112*b* and before the base 112*a*. In some examples, the cleaning station 110 is adapted to contact the base 112*a* and the oxidizing agent 112*b* at the same time with the photoconductor 104. The cleaning station 110 may comprise a receptacle containing the base 112*a* and the oxidizing agent 112*b* in a carrier liquid (e.g., water, which may be deionized water) as a single base-peroxide solution 112, so that the photoconductor 104 can be contacted with the base-peroxide solution 112. The cleaning station 110 may retain the base 112*a* and the photoconductor 104 in any suitable receptacle, which may have walls of a material that is resistant to corrosion from the base 112*a* and the oxidizing agent 112*b*. The receptacle may, for example, have walls comprising a material selected from a glass, a metal, such as stainless steel, or a plastic, such as polyethylene.

In some examples, contacting the photoconductor 104 with the base-peroxide solution 112 can include immersing some or all of the photoconductor 104 in the solution 112. In other examples, contacting the photoconductor 104 with the base-peroxide solution 112 can include spraying or running a base-peroxide solution 112 comprising the base 112*a* and the oxidizing agent 112*b* over some or all of the surface of the photoconductor 104.

In some examples, system 100 can be adapted to automatically transfer the amorphous silicon photoconductor 104 from the printing device 102 to the cleaning station 110, carry out a method of cleaning the photoconductor 104 involving contacting the photoconductor 104 with a base 112*a* and an oxidizing agent 112*b*, rinse the photoconductor 104 with a liquid, and transfer the photoconductor 104 from the cleaning station 110 back to the printing device 102. The system 100 may be adapted to transfer the photoconductor 104 from the printing device 102 to the cleaning station 110 at a point that is initiated by a user or at a point that is predetermined, such as when a certain level of background is measured on print media during printing, or when a certain number of print cycles has been reached (e.g., on the order of 200,000 print cycles to 1,000,000 print cycles. The system 100 may be adapted to carry out a method as described herein, either manually or automatically, and may be controlled by a computer.

The method may involve rinsing the photoconductor 104 with a rinsing solution 114, which may lack or substantially lack an oxidizing agent and a base. The rinsing solution 114 used for rinsing may be the same as or different from any liquid used in the base-peroxide solution 112 for the oxidizing agent 112*b* and the base 112*a* during the contacting step. The method may involve rinsing the photoconductor 104 with a rinsing solution 114 immediately after contacting the photoconductor 104 with the base 112*a* and the oxidizing agent 112*b*. There may be no intervening steps between contacting the photoconductor 104 with the base 112*a* and the oxidizing agent 112*b*, and rinsing the photoconductor 104 with a rinsing solution 114. Rinsing may include, for example, immersing the photoconductor 104 in the rinsing solution 114, or spraying or running the rinsing solution 114 over the surface of the photoconductor 104. The rinsing solution 114 may be a rinsing solution 114 in which the base and/or the oxidizing agent are soluble. The rinsing solution 114 may be a protic solvent (e.g., selected from water and an alkanol). The rinse may remove all or substantially all of the base 112*a* and the oxidizing agent 112*b* from the photoconductor 104, and any other matter that may have been removed from the surface of the photoconductor 104 during the contact with the base 112*a* and the oxidizing agent 112*b*.

The base 112*a* can be selected from a metal hydroxide, ammonia, an alkyl amine, a metal carbonate, and a metal hydrogen carbonate, and/or the base may be dissolved in a liquid carrier medium, which may be a protic solvent, including, but not limited to, a protic solvent selected from water and an alkanol (e.g., a C1 to C5 alkanol, methanol and ethanol). In some examples, the base can be ammonium hydroxide, which can be considered to be ammonia in water. The metal hydroxide can be selected from an alkali metal hydroxide, including, but not limited to, lithium hydroxide, sodium hydroxide, potassium hydroxide, and caesium hydroxide, and an alkali earth metal hydroxide, including, but not limited to, magnesium hydroxide, calcium hydroxide and barium hydroxide. The alkyl amine may be selected from a primary alkyl amine, a secondary alkyl amine and a tertiary alkyl amine. The alkyl amine may be of the formula NRaRbRc, wherein Ra, Rb and Rc are each selected from H and an optionally substituted alkyl, and at least one of Ra, Rb and Rc is an optionally substituted alkyl, which may be straight chain or branched and which may be an optionally substituted C1 to C10 alkyl (C1 to C10 not including any substituents that may be present), in some examples an optionally substituted C1 to C5 alkyl, in some examples an optionally substituted C1 to C3 alkyl. If the alkyl is substituted, the substituents on the alkyl may be selected, for example, from hydroxyl, alkyloxy, aryl, and halogen. The alkyl amine may be selected from methylamine, ethylamine, ethanol amine, dimethylamine, methylethanolamine and trimethylamine. The metal of the aqueous metal hydroxides can be selected from alkali metal hydroxides, including, but not limited to, lithium hydroxide, sodium hydroxide, potassium hydroxide, and caesium hydroxide. The metal of the metal carbonates or metal hydrogen carbonates may be an alkali metal (e.g., lithium, sodium or potassium).

The oxidizing agent 112*b* may be selected from a peroxide, ozone, a peroxyacid, and an oxyacid, which may be a metal oxyacid. The peroxide may be selected from hydrogen peroxide, barium peroxide, benzoyl peroxide, 2-butanone peroxide, tert-butyl hydroperoxide, calcium peroxide, cumene hydroperoxide, dicumyl peroxide, lithium peroxide, benzoyl peroxide, benzoyl peroxide, di-tert-butyl peroxide, di-tert-amyl peroxide, lauroyl peroxide, tert-butyl hydroperoxide, magnesium peroxide, nickel peroxide, sodium peroxide, strontium peroxide and zinc peroxide. The peroxy acid may be selected from perbenzoic acid, 3-chloroperbenzoic acid, peracetic acid. The oxidizing agent may be selected from a chromate, a permanganate and osmium tetroxide. The chromate may be selected from ammonium dichromate, 2,2_-Bipyridinium chlorochromate, bis(tetrabutylammonium) dichromate, chromium(VI) oxide, imidazolium dichromate, potassium dichromate, pyridinium dichromate, sodium dichromate dehydrate, and tetrabutylammonium chlorochromate.

In some examples, the base-peroxide solution 112 containing the base 112*a* and the oxidizing agent 112*b* is formed by combining 1 part by volume of ammonium hydroxide (e.g. containing about 20-30 wt % ammonia, the balance being water), 1 part by volume of aqueous hydrogen peroxide (e.g., containing about 20 to 35 wt % hydrogen peroxide, with the balance water) and 5 parts by volume water, which may be deionized water.

In some examples, the base-peroxide solution 112, or the base 112*a* and the oxidizing agent 112*b* separately, are at a temperature of approximately 75° C. to 80° C. during the contacting with the amorphous silicon photoconductor 104. However, in other examples, the base-peroxide solution 112, or the base 112*a* and the oxidizing agent 112*b* separately, can be at a temperature within the range of about 40° C. to 100° C. during the contacting with the photoconductor 104. In some examples, the base-peroxide solution 112, or the base 112*a* and the oxidizing agent 112*b* separately, may contact the photoconductor 104 for a period of time on the order of 10 minutes. However, in other examples, the contact period may be a period within the range of about 1 minute to 20 minutes.

Figure 2:
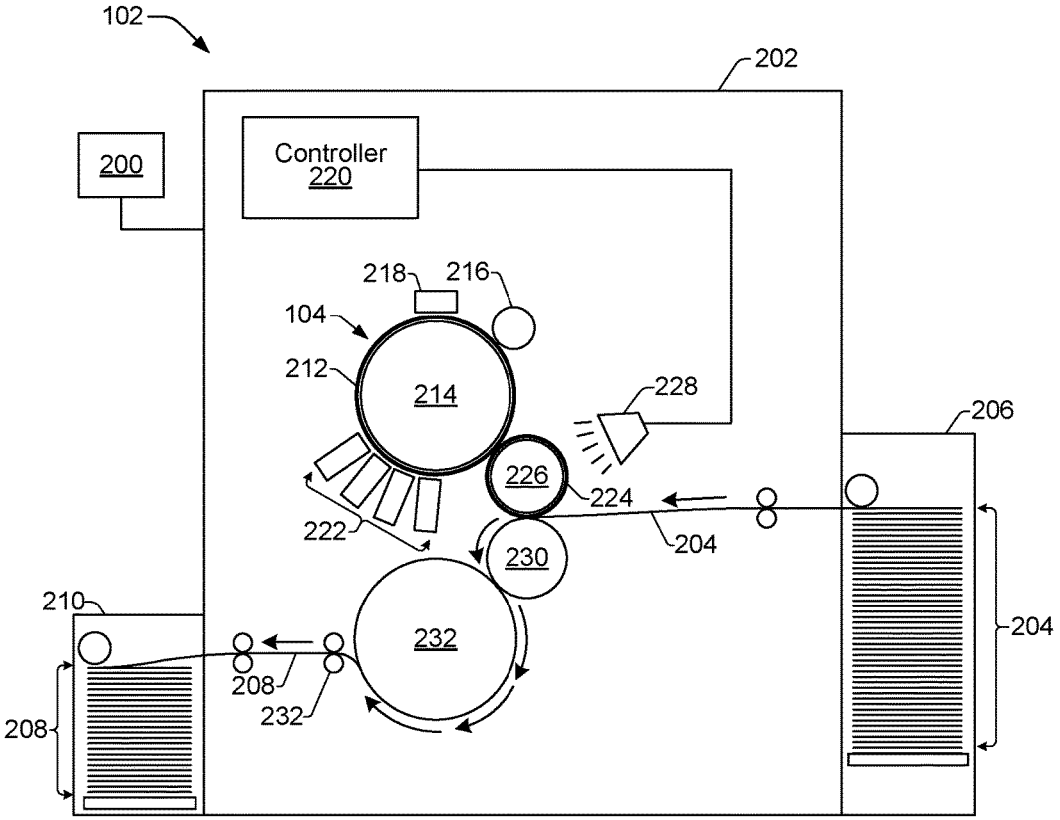
FIG. 2 shows an example of a printing device suitable for use in a system for cleaning an amorphous silicon photoconductor.

FIG. 2 illustrates an example of a printing device 102 suitable for use in a system 100 for cleaning an amorphous silicon photoconductor 104. As noted above, printing device 102 comprises a print-on-demand device, implemented as a liquid electrophotographic (LEP) printing press 102. An LEP printing press 102 generally includes a user interface 200 that enables the press operator to manage various aspects of printing, such as loading and reviewing print jobs, proofing and color matching print jobs, reviewing the order of the print jobs, and so on. The user interface 200 typically includes a touch-sensitive display screen that allows the operator to interact with information on the screen, make entries on the screen, and generally control the press 102. In one example, the user interface 200 enables the press operator to manually initiate a pause phase that temporarily suspends printing, and then to end the pause phase in order to resume printing. A user interface 200 may also include other devices such as a key pad, a keyboard, a mouse, and a joystick, for example.

A LEP printing press 102 includes a print engine 202 that receives a print substrate, illustrated as print media 204 (e.g., cut-sheet paper or a paper web) from a media input mechanism 206. After the printing process is complete, the print engine 202 outputs the printed media 208 to a media output mechanism, such as a media stacker tray 210. The printing process is generally controlled by a print controller 220 to generate the printed media 208 using digital image data that represents words, pages, text, and images that can be created, for example, using electronic layout and/or desktop publishing programs. Digital image data is generally formatted as one or more print jobs stored and executed on print controller 220, as further discussed below with reference to FIG. 3.

The print engine 202 includes a photo imaging component, such as an amorphous silicon photoconductor 104 that is removable from the print engine 202. Photoconductor 104 comprises an amorphous silicon photoreceptor layer 212 mounted on (e.g., wrapped around) an imaging drum 214 or imaging cylinder 214. The amorphous silicon photoreceptor layer 212 defines an outer surface of the imaging drum 214 and/or photoconductor 104 on which images can be formed. A charging component such as charge roller 216 generates electrical charge that flows toward the photoreceptor surface and covers it with a uniform electrostatic charge. The print controller 220 uses digital image data to control a laser imaging unit 218 to selectively expose the photoconductor 104. The laser imaging unit 218 exposes image areas on the photoconductor 104 by dissipating (neutralizing) the charge in those areas. Exposure of the photoconductor 104 creates a 'latent image' in the form of an invisible electrostatic charge pattern that replicates the image to be printed.

After the latent/electrostatic image is formed on the photoconductor 104, the image is developed by a binary ink development (BID) roller 222 to form an ink image on the outer surface of the photoconductor 104. Each BID roller 222 develops one ink color in the image, and each developed color corresponds with one image impression. While four BID rollers 222 are shown, indicating a four color process (i.e., a CMYK process), other press implementations may include additional BID rollers 222 corresponding to additional colors. In addition, although not illustrated, print engine 202 includes an erase mechanism and an internal cleaning mechanism which are generally incorporated as part of any electrophotographic process. In a first image transfer, the single color separation impression of the ink image developed on the photoconductor 104 is transferred electrically and by pressure from the photoconductor 104 to an image transfer blanket 224. The image transfer blanket 224 is primarily referred to herein as the print blanket 224 or blanket 224. The ink layer is transferred electrically and by pressure to the blanket 224 as the photoconductor 104 rotates into contact with the electrically charged blanket 224 rotating on the ITM drum 226, or transfer drum 226. The print blanket 224 is electrically charged through the transfer drum 226. The print blanket 224 overlies, and is securely attached to, the outer surface of the transfer drum 226.

The print blanket 224 can be heated both by an internal heating source within the ITM/transfer drum 226, and from an external heating source such as an infrared heating lamp 228. The heating source within the drum 226 can also be infrared heating lamps (not illustrated). While the external heating lamp 228 is illustrated as a single lamp, this is not to be construed as a limitation regarding the number, type, or configuration of such a heating lamp. Rather, heating lamp 228 is intended to represent a range of suitable configurations of heating lamps. For example, heating lamp 228 can comprise one or multiple heating lamps in various configurations, such as multiple heating lamps configured in parallel that are controlled together or individually, such as where power can be changed to all of the heating lamps at once or to just one specific heating lamp.

In different examples, the heated blanket 224 can perform different functions, such as an image transfer function during normal printing, or a heat cycling function to heat the photoconductor 104. For example, in a normal printing function, the heat from the heated blanket 224 causes most of the carrier liquid in the ink to evaporate, and it also causes the particles in the ink to partially melt and blend together. This results in a finished ink image in the form of a hot, nearly dry, tacky plastic ink film. In a second image transfer, this hot ink film image impression is then transferred to a substrate such as a sheet of print media 204, which is held by an impression drum/cylinder 230. The temperature of the print media substrate 204 is below the melting temperature of the ink particles, and as the ink film comes into contact with the print media substrate 204, the ink film solidifies, sticks to the substrate, and completely peels off from the blanket 224.

This imaging process is repeated for each color separation in the image, and the print media 204 remains on the impression drum 230 until all the color separation impressions (e.g., C, M, Y, and K) in the image are transferred to the print media 204. After all the color impressions have been transferred to the sheet of print media 204, the printed media 208 sheet is transported by various rollers 232 from the impression drum 230 to the output mechanism 210.

Figure 3:
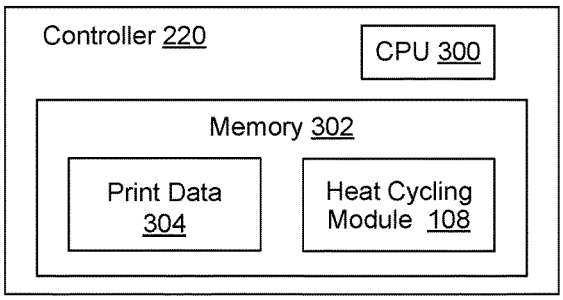
FIG. 3 shows a box diagram of an example controller suitable for implementing within an LEP printing press to control a heat cycling process to evaporate remaining rinsing solution from a silicon photoconductor.

FIG. 3 shows a box diagram of an example controller 220 suitable for implementing within an LEP printing press 102 to control a heat cycling process to evaporate remaining rinsing solution 114 from the photoconductor 104 after cleaning the photoconductor 104 in a cleaning station 110. Referring to FIGS. 2 and 3, print controller 220 generally comprises a processor (CPU) 300 and a memory 302, and may additionally include firmware and other electronics for communicating with and controlling the other components of print engine 202, the user interface 200, and media input (206) and output (210) mechanisms. Memory 302 can include both volatile (i.e., RAM) and nonvolatile (e.g., ROM, hard disk, optical disc, CD-ROM, magnetic tape, flash memory, etc.) memory components. The components of memory 302 comprise non-transitory, machine-readable (e.g., computer/processor-readable) media that provide for the storage of machine-readable coded program instructions, data structures, program instruction modules, JDF (job definition format), and other data for the printing press 102, such as heat cycling module 108. The program instructions, data structures, and modules stored in memory 302 may be part of an installation package that can be executed by processor 300 to implement various examples, such as examples discussed herein. Thus, memory 302 may be a portable medium such as a CD, DVD, or flash drive, or a memory maintained by a server from which the installation package can be downloaded and installed. In another example, the program instructions, data structures, and modules stored in memory 302 may be part of an application or applications already installed, in which case memory 302 may include integrated memory such as a hard drive.

As noted above, controller 220 uses digital image data to control the laser imaging unit 218 in the print engine 202 to selectively expose the photoconductor 104. More specifically, controller 220 receives print data 304 from a host system, such as a computer, and stores the data 304 in memory 302. Data 304 represents, for example, documents or image files to be printed. As such, data 304 forms one or more print jobs for printing press 102 that each include print job commands and/or command parameters. Using a print job from data 204, print controller 220 controls components of print engine 202 (e.g., laser imaging unit 218) to form characters, symbols, and/or other graphics or images on print media 204 through a printing process as has been generally described above with reference to FIG. 2.

Referring to FIGS. 2 and 3, as previously mentioned, in addition to an image transfer function, the heated blanket 224 enables a photoconductor heat cycling function to heat the amorphous silicon photoconductor 104 and evaporate rinsing solution 114 that may remain on the surface of the photoconductor 104 after the photoconductor 104 undergoes a cleaning process in cleaning station 110. This heat cycling function can be controlled, for example, by controller 220 executing instructions from heat cycling module 108. Thus, heat cycling module 108 comprises machine-readable instructions that are executable on processor 300 to control the heat cycling of photoconductor 104. Controlling the heat cycling can include controlling a photoconductor heater 106 (e.g., heating lamp 228 and blanket 224) to cycle the temperature of the photoconductor 104. In one example, cycling the photoconductor 104 temperature includes heating the blanket 224 with heating lamp 228, and engaging the blanket 224 with the photoconductor 104 as imaging drum 214 and ITM drum 226 rotate against one another. Thus, upon receiving the photoconductor 104 in the printing press 102 from a cleaning station 110, the controller 220 can heat the blanket 224 with heating lamp 228, and cause the heated blanket 224 to be rotated against the photoconductor 104 to heat the photoconductor 104. The heated blanket 224 can be engaged and disengaged with the photoconductor 104 in this manner a number of times in order to cycle the temperature of the photoconductor 104 up and down. Heating the photoconductor 104 in this manner for time durations and at temperatures described herein, evaporates rinsing solution 114 that may remain on the surface of the photoconductor 104 after the photoconductor 104 has been cleaned and rinsed in the cleaning station 110.

Thus, in some examples, the heating lamps 228 and blanket 224 generally comprise a photoconductor heating mechanism 106 as discussed above with regard to FIG. 1. However, in other examples, heat may also be applied directly to photoconductor 104 using other appropriate photoconductor heating mechanisms 106, rather than applying heat from the blanket 224. For example, photoconductor 104 may be heated more directly from both internal heating sources positioned within the imaging drum 214, and from external heating sources positioned outside the drum 214. Such heating mechanisms can include infrared heating lamps, for example.

Figure 4:
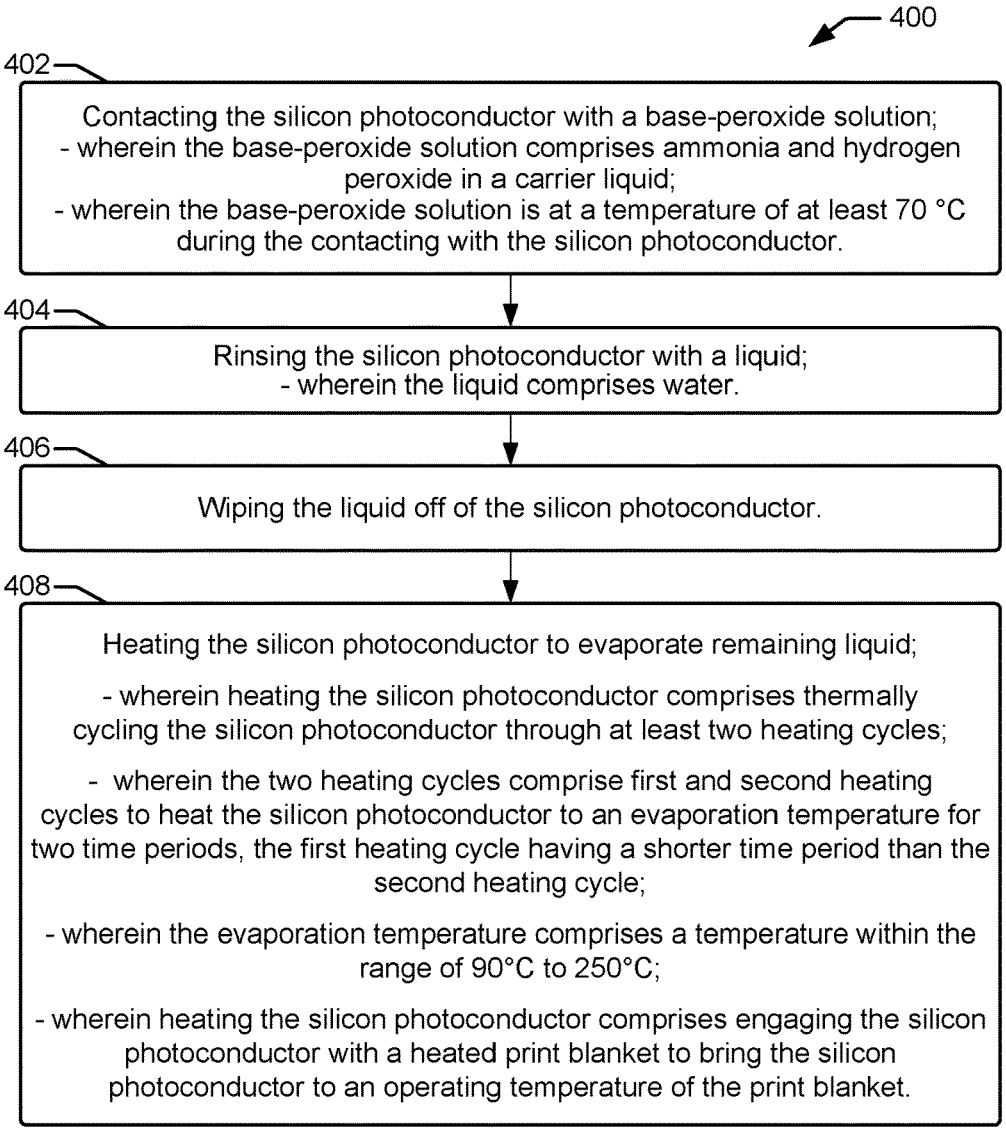
FIGS. 4 and 5 show flow diagrams that illustrate example methods related to cleaning an amorphous silicon photoconductor in a cleaning station using a base-peroxide solution and heat cycling the photoconductor to evaporate liquid following the cleaning.
Figure 5:
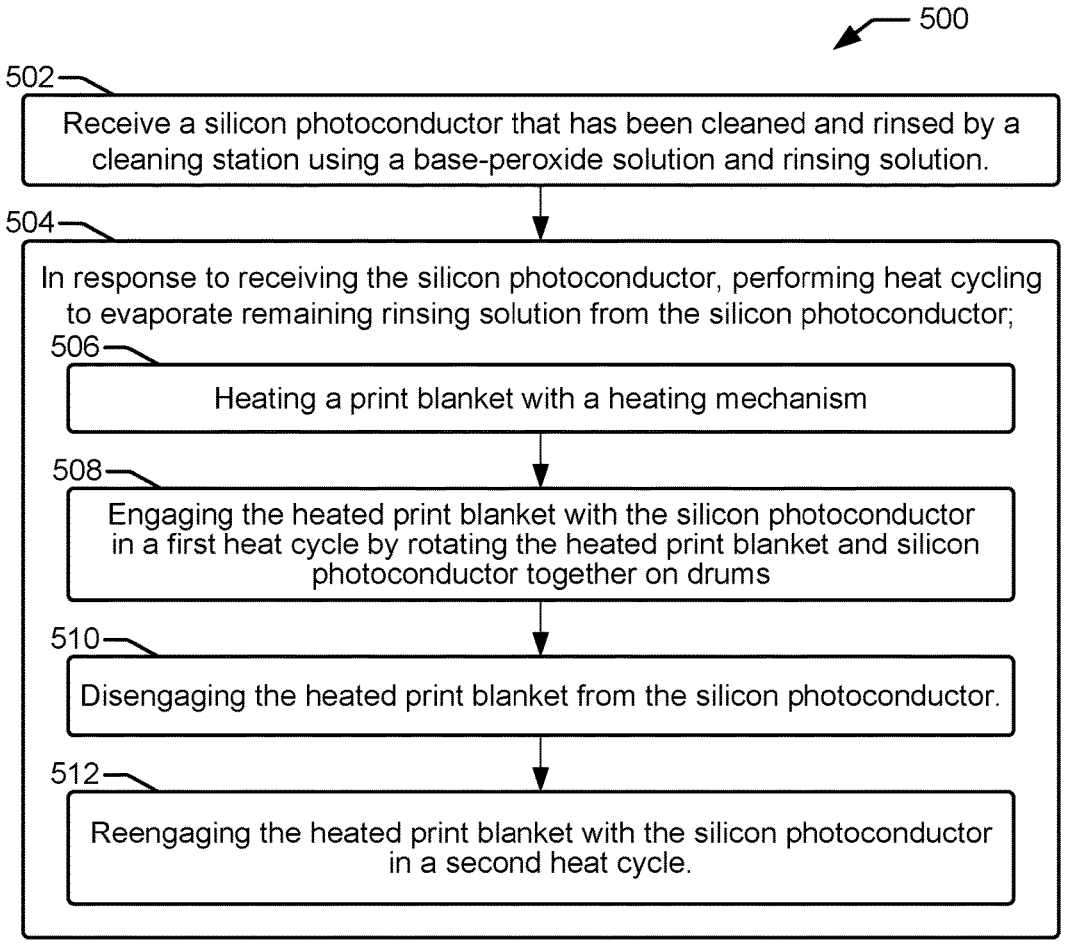

FIGS. 4 and 5 show flow diagrams that illustrate example methods 400 and 500, related to cleaning an amorphous silicon photoconductor in a cleaning station using a base-peroxide solution and heat cycling the photoconductor to evaporate liquid following the cleaning. Methods 400 and 500 are associated with the examples discussed above with regard to FIGS. 1-3, and details of the operations shown in methods 400 and 500 can be found in the related discussion of such examples. The operations of methods 400 and 500 may be embodied as programming instructions stored on a non-transitory, machine-readable (e.g., computer/processor-readable) medium, such as memory 302 as shown in FIG. 3. In some examples, implementing the operations of methods 400 and 500 can be achieved by a processor, such as a processor 300 of FIG. 3, reading and executing the programming instructions stored in a memory 302. In some examples, implementing the operations of methods 400 and 500 can be achieved using an ASIC (application specific integrated circuit) and/or other hardware components alone or in combination with programming instructions executable by processor 300.

Methods 400 and 500 may include more than one implementation, and different implementations of methods 400 and 500 may not employ every operation presented in the respective flow diagrams. Therefore, while the operations of methods 400 and 500 are presented in a particular order within the flow diagrams, the order of their presentation is not intended to be a limitation as to the order in which the operations may actually be implemented, or as to whether all of the operations may be implemented. For example, one implementation of method 400 might be achieved through the performance of a number of initial operations, without performing one or more subsequent operations, while another implementation of method 400 might be achieved through the performance of all of the operations.

Referring now to the flow diagram of FIG. 4, an example method 400 of cleaning a silicon photoconductor begins at block 402, with contacting the silicon photoconductor with a base-peroxide solution. In some examples, the contacting occurs in a cleaning station after the photoconductor is removed and transferred manually or automatically from an electrophotographic printing device. In some examples, the base-peroxide solution comprises ammonia and hydrogen peroxide in a carrier liquid. In some examples, the base-peroxide solution is at a temperature of at least 70° C. during the contacting with the silicon photoconductor. As shown at block 404, the method continues with rinsing the silicon photoconductor with a liquid, which can include water, for example. As shown at block 406, excess rinsing liquid can then be wiped off of the silicon photoconductor, for example, using a lint-free wipe.

The method 400 can continue as shown at block 408, with heating the silicon photoconductor to evaporate liquid that might be remaining on the surface of the photoconductor. In some examples, the heating comprises transferring the silicon photoconductor back from the cleaning station to the electrophotographic printing device, and then heat cycling the silicon photoconductor in the electrophotographic printing device. The heat cycling can include a single cycle that increases the photoconductor temperature once, or multiple cycles that increase the photoconductor temperature multiple times. A single heat cycle can keep the photoconductor at a higher temperature for a longer time period than multiple heat cycles. In some examples, the time period of a heat cycle can depend on the number of heat cycles being performed and/or the temperature of the heat cycle, and may range from 15 minutes to 90 minutes. In some examples, heating the silicon photoconductor comprises engaging the silicon photoconductor with a heated print blanket to bring the silicon photoconductor to an operating temperature of the print blanket. In some examples, heating the silicon photoconductor comprises heat cycling the silicon photoconductor up to an evaporation temperature within the range of 90° C. to 250° C.

Referring now to the flow diagram of FIG. 5, an example method 500 related to cleaning an amorphous silicon photoconductor is shown. The method 500 begins at block 502 with receiving a silicon photoconductor that has been cleaned and rinsed by a cleaning station, where the cleaning uses a base-peroxide solution and rinsing uses a rinsing solution such as water. The photoconductor can be received at a printing press from the cleaning station. As shown at block 504, heat cycling is then performed in response to receiving the silicon photoconductor. The heat cycling is to evaporate remaining rinsing solution from the silicon photoconductor. The heat cycling can take place in the printing press. As shown at block 506, heat cycling can include heating a print blanket with a heating mechanism. The heat cycling can include engaging the heated print blanket with the silicon photoconductor in a first heat cycle by rotating the heated print blanket and silicon photoconductor together on drums, as shown at block 508. The heat cycling can further include disengaging the heated print blanket from the silicon photoconductor, and then reengaging the heated print blanket with the silicon photoconductor in a second heat cycle, as shown at blocks 510 and 512, respectively.

What is claimed is:

1. A method of cleaning a silicon photoconductor comprising:

contacting the silicon photoconductor with a base-peroxide solution;

rinsing the silicon photoconductor with a liquid; and heating the silicon photoconductor to evaporate the liquid, wherein heating the silicon photoconductor comprises engaging the silicon photoconductor with a heated print blanket to bring the silicon photoconductor to an operating temperature of the heated print blanket.

2. The method of claim 1, wherein the base-peroxide solution comprises ammonia and hydrogen peroxide in a carrier liquid.

3. The method of claim 1, wherein the base-peroxide solution is at a temperature of at least 70° C. during the contacting with the silicon photoconductor.

4. The method of claim 1, further comprising wiping liquid off of the silicon photoconductor before heating the silicon photoconductor, wherein the liquid used in rinsing the silicon photoconductor comprises water.

5. The method of claim 1, wherein contacting the silicon photoconductor with the base-peroxide solution comprises transferring the silicon photoconductor from an electrophotographic printing device to a cleaning station, and heating the silicon photoconductor comprises transferring the silicon photoconductor back from the cleaning station to the electrophotographic printing device.

6. The method of claim 5, wherein heating the silicon photoconductor comprises heat cycling the silicon photoconductor in the electrophotographic printing device.

7. The method of claim 1, wherein heating the silicon photoconductor comprises heat cycling the silicon photoconductor up to an evaporation temperature within a range of 90° C. to 250° C.

8. The method of claim 1, wherein the base-peroxide solution comprises deionized water, $NH_4OH$, and aqueous $H_2O_2$.

9. The method of claim 8, wherein the deionized water, the $NH_4OH$, and the aqueous $H_2O_2$ have a ratio of about 5:1:1, respectively.

10. A system for cleaning a silicon photoconductor comprising:

an electrophotographic printing device;

a silicon photoconductor removable from the electrophotographic printing device;

a cleaning station comprising a base-peroxide solution and a rinsing solution, the cleaning station to receive the silicon photoconductor, contact the photoconductor with the base-peroxide solution, and rinse the photoconductor with the rinsing solution; and a photoconductor heating mechanism to heat the photoconductor to evaporate the rinsing solution from the photoconductor, wherein the system is adapted to automatically transfer the silicon photoconductor from the electrophotographic printing device to the cleaning station, clean the silicon photoconductor by contacting the silicon photoconductor with the base-peroxide solution and rinsing it with the rinsing solution, and transfer the silicon photoconductor from the cleaning station back to the electrophotographic printing device.

11. The system of claim 10, wherein the removable silicon photoconductor comprises an amorphous silicon photoconductor.

12. The system of claim 10, wherein the photoconductor heating mechanism comprises a heated printing blanket on the electrophotographic printing device brought into contact with the photoconductor.

13. The system of claim 12, further comprising a heat cycling module to control the contact of the printing blanket against the photoconductor.

14. The system of claim 10, the base-peroxide solution comprises deionized water, $NH_4OH$, and aqueous $H_2O_2$.

15. The system of claim 14, wherein the deionized water, the $NH_4OH$, and the aqueous $H_2O_2$ have a ratio of about 5:1:1, respectively.

16. A non-transitory machine-readable storage medium storing instructions that when executed by a processor of a printing device, cause the printing device to:

receive a silicon photoconductor that is cleaned and rinsed by a cleaning solution and a rinsing solution, respectively;

in response to receiving the silicon photoconductor, performing heat cycling to evaporate remaining rinsing solution from the silicon photoconductor.

17. The machine-readable storage medium of claim 16, wherein performing heat cycling comprises:

heating a print blanket with a heating mechanism;

engaging the heated print blanket with the silicon photoconductor in a first heat cycle by rotating the heated print blanket and the silicon photoconductor together on drums;

disengaging the heated print blanket from the silicon photoconductor; and reengaging the heated print blanket with the silicon photoconductor in a second heat cycle.

18. The machine-readable storage medium of claim 16, wherein the cleaning solution uses a base peroxide solution.

* * * * *